US006935869B1

(12) United States Patent
Auclair

(10) Patent No.: US 6,935,869 B1
(45) Date of Patent: Aug. 30, 2005

(54) METER BOX GROUND CLAMP

(75) Inventor: Randolph L. Auclair, New Hartford, CT (US)

(73) Assignee: Electric Motion Company, Inc., Winsted, CT (US)

( * ) Notice: Subject to any disclaimer, the term of this patent is extended or adjusted under 35 U.S.C. 154(b) by 0 days.

(21) Appl. No.: 10/843,982

(22) Filed: May 12, 2004

(51) Int. Cl.[7] ..... H01R 4/66
(52) U.S. Cl. ..... 439/92; 439/803; 174/51
(58) Field of Search ..... 439/92, 100, 803, 439/811; 174/51, 40 CC; 361/759

(56) References Cited

U.S. PATENT DOCUMENTS

| | | | | |
|---|---|---|---|---|
| 2,420,895 | A * | 5/1947 | Merriman | 439/803 |
| 4,106,832 | A * | 8/1978 | Burns | 439/100 |
| 4,784,621 | A | 11/1988 | Auclair | 439/793 |
| 4,828,504 | A * | 5/1989 | Franks, Jr. | 439/92 |
| 5,556,299 | A * | 9/1996 | Finke | 439/479 |
| 5,746,609 | A | 5/1998 | Franks, Jr. | 439/92 |
| 5,928,006 | A | 7/1999 | Franks, Jr. | 439/92 |
| 6,329,592 | B1 | 12/2001 | Auclair | 174/51 |
| 6,494,726 | B1 * | 12/2002 | Auclair | 439/92 |
| 6,572,390 | B2 * | 6/2003 | Ladin | 439/92 |
| 6,857,881 | B1 * | 2/2005 | Balfour | 439/92 |

* cited by examiner

*Primary Examiner*—Gary Paumen
(74) *Attorney, Agent, or Firm*—Alix, Yale & Ristas, LLP

(57) ABSTRACT

A meter box ground clamp for clamping a ground wire to a metallic meter box includes a clamp body, a wedge body, a bolt member and a ground engagement bolt. The clamp body has a base segment and first and second leg segments, each of the leg segments having a laterally extending extension segment for engaging the exterior surface of the meter box drip cap. The wedge body includes an upper segment disposed proximate to the clamp body legs, a lower segment disposed proximate to the clamp body base segment, and a middle segment extending from the lower segment, through a slot of the clamp body base segment, to the upper segment. The bolt member head is disposed above an upper portion of the clamp body base segment, with the shaft extending downwardly through an opening of the base segment upper portion. The bolt member shaft threadably engages an opening of the wedge body middle segment for driving the wedge body upper portion between the meter box drip cap and the meter box panel to electrically connect the ground clamp to the meter box. The threaded shaft of the ground engagement bolt is received within a threaded opening of the wedge body lower segment to clamp a ground wire positioned within a bore of the wedge body lower segment.

16 Claims, 7 Drawing Sheets

METER BOX GROUND CLAMP

BACKGROUND OF THE INVENTION

This invention relates generally to devices for implementing a ground connection between an electrical meter box and a common ground point. More particularly, the present invention relates generally to clamp devices which mount to an electrical meter box and connect via a flexible conductor with a common ground point.

A number of various types of devices have been employed for connecting a ground wire with an electrical meter box. Most conventional devices employ clamp assemblies of various forms. In applications to which the present invention relates, the connecting devices are ordinarily clamped onto the exterior of the electrical meter box which is mounted on the wall of a building.

A number of conventional designs are configured to mount rigidly or semi-rigidly onto the electrical meter box. For such designs, damage to the electrical meter box can occur when the clamping force is applied to the electrical meter box. For example, it is not uncommon for the electrical meter box to be bent or twisted when the clamping force is applied.

In another known design, the device clamps onto a corner of the electrical meter box. A lower flange of the device engages a bottom skirt of the electrical meter box top cover. A bolt threadably disposed through a top plate of the device engages the electrical meter box top cover. Applying a torque to the bolt causes the device to be clamped to the electrical meter box. Such devices may not provide an adequate electrical connection with the electrical meter box.

A ground clamp disclosed in U.S. Pat. No. 6,329,592 includes a U-shaped clamp member having first and second legs which form a slot. A pair of openings in the first leg form a center segment disposed between two fingers. The edge portion of the meter box enclosure is resiliently clamped within the slot between the fingers and the second leg. The center segment includes a threaded socket. A bolt member has a stud portion and a bolt head portion, the stud portion including a threaded segment disposed proximate the distal end and an unthreaded shaft segment disposed intermediate the threaded segment and the bolt head portion. At least one protrusion extends axially from the distal end of the bolt member to a sharp edge. The stud portion is mounted in the socket of the clamp member such that the shaft segment is positioned in the threaded portion of the socket and the threaded segment is positioned within the slot when the sharp edge of the protrusion contacts the exterior surface of the edge portion received within the slot. The sharp edge of the protrusion removes the corrosion inhibiting coating from the exterior surface of the edge portion to electrically connect the meter box to the clamp without deforming the meter box enclosure upon rotation of the bolt member. However, a hammer or similar tool is usually required to insert the second leg of the clamp member between the bottom skirt of the meter box top cover and the side or front panel of the meter box.

SUMMARY OF THE INVENTION

Briefly stated, the invention in a preferred form is a meter box ground clamp for clamping a ground wire to a metallic meter box. The meter box ground clamp comprises a U-shaped clamp body, a wedge body, a bolt member and a ground engagement bolt. The clamp body includes first and second leg segments and a base segment, the base segment and leg segments forming a vertically extending, open channel. Each of the leg segments has a laterally extending upper extension segment. The base segment has a lower portion having a vertically extending slot, a middle portion, and an upper portion having an opening and extending at an angle from the middle portion into the channel. The wedge body includes an upper segment disposed proximate to the clamp body legs, a lower segment disposed proximate to the clamp body base segment, and a middle segment extending substantially horizontally from the lower segment, through the slot of the clamp body base segment, to the upper segment. The wedge body upper segment has a substantially triangular shape. The wedge body lower segment has a substantially cylindrical lower portion having a sidewall defining an axially extending bore and a laterally extending threaded opening. The wedge body middle segment has a vertically extending, axial threaded opening. The bolt member includes a bolt head disposed above the upper portion of the clamp body base segment, and a shaft extending downwardly from the bolt head through the opening of the upper portion of the clamp body base segment, at least a portion of the shaft having a threaded surface threadably engaged with the opening of the wedge body middle segment. The ground engagement bolt includes a bolt head, and a threaded shaft extending from the bolt head. The threaded shaft is received within the threaded opening of the wedge body lower segment and is threadably displaceable therein to clamp a ground wire positioned within the bore of the wedge body lower segment. The extension segments of the clamp body legs are adapted for engaging the exterior surface of the drip cap and the bolt member is adapted for threadably driving the wedge body upper portion into the meter box overlap joint such that the wedge body upper portion mechanically engages the abutting surfaces of the edge portion of the meter box drip cap and the upper end portion of the meter box panel to electrically connect the ground clamp to the meter box.

The upper portion of the wedge body lower segment includes first and second laterally extending wings. The width of the wings and the width of the base edge of the wedge body upper segment are each greater than the width of the slot of the clamp body base segment, such that the wedge body is retained to the clamp body while allowing vertical movement of the wedge body relative to the clamp body. The wedge body upper segment extends at an obtuse angle ($\gamma$) from the wedge body middle segment and the wedge body lower segment extends at a right angle ($\alpha$) from the wedge body middle segment. Preferably, angle $\gamma$ is substantially equal to 96° and angle $\alpha$ is substantially equal to 90°.

The front and rear faces of the wedge body upper segment have a wedge-shape profile, widening from the upper tip to the bottom edge. Preferably, the front and rear faces of the wedge body upper segment form an angle substantially equal to 6°. The front face of the wedge body upper segment has an abrading surface, formed by multiple serrations. Preferably, each of the serrations has a depth substantially equal to 0.005 inches and forms an angle with the base edge substantially equal to 68°.

Each leg segment has upper, middle and lower portions, with the extension segment extending laterally from a front edge of the middle portion. The extension segment includes a front portion having a downwardly extending tooth, for penetrating the corrosion inhibiting coating on the meter box drip cap.

An object of the invention is to provide a new and improved ground clamp for implementing a ground connection between an electrical meter box and a common ground point.

Another object of the invention is to provide a new and improved ground clamp for use with an electrical meter box that is easily installed.

A further object of the invention is to provide a new and improved ground clamp which is inexpensive to manufacture.

Other objects and advantages of the invention will become apparent from the drawings and specification.

BRIEF DESCRIPTION OF THE DRAWINGS

The present invention may be better understood and its numerous objects and advantages will become apparent to those skilled in the art by reference to the accompanying drawings in which.

DETAILED DESCRIPTION OF THE PREFERRED EMBODIMENT

Figure 1:
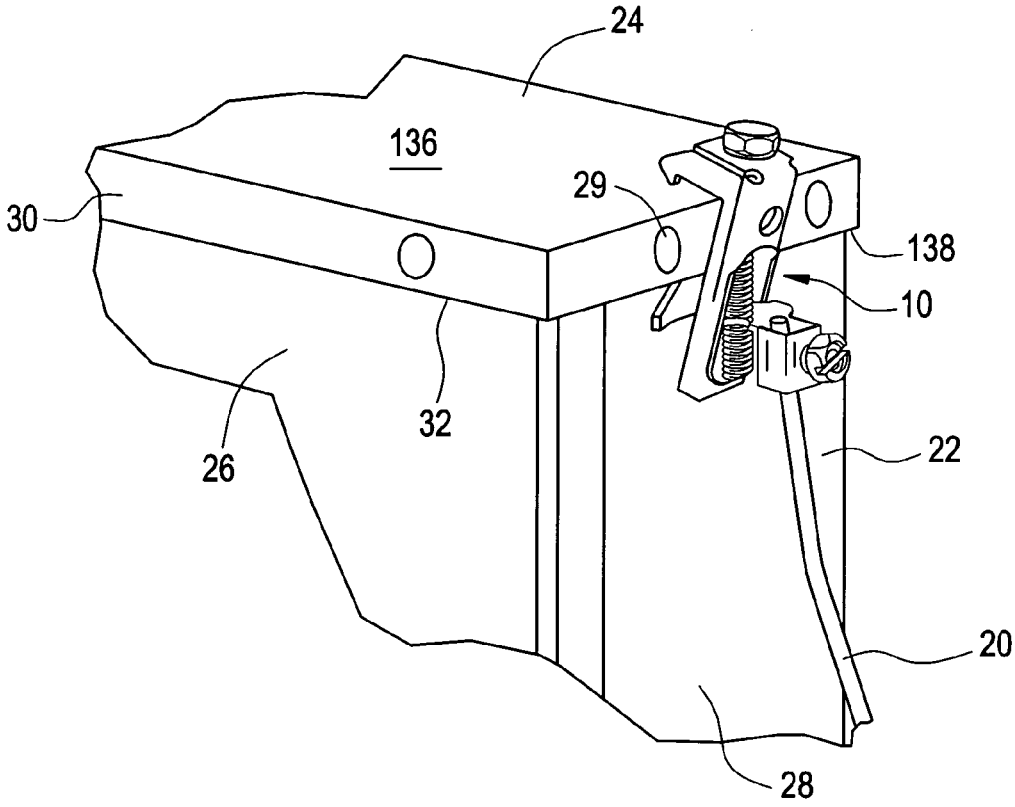
FIG. 1 is a perspective view of a meter box ground clamp in accordance with the invention which is installed on a meter box.
Figure 2:
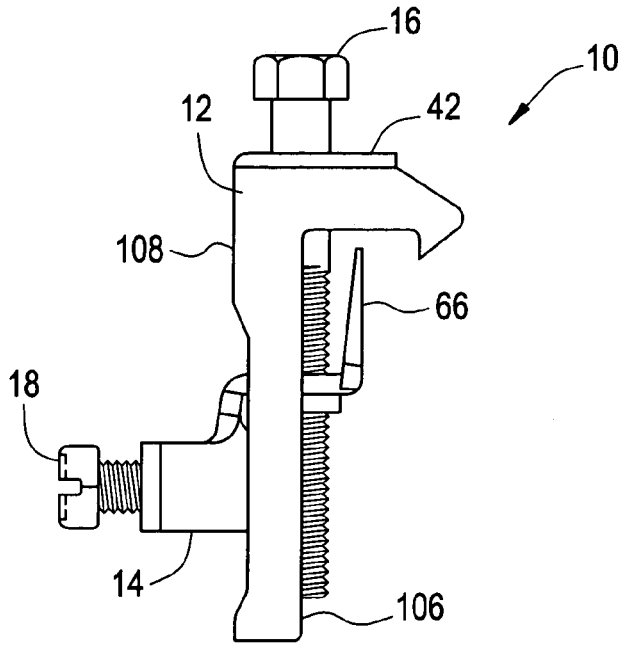
FIG. 2 is an enlarged side view of the meter box ground clamp of FIG. 1.
Figure 3:
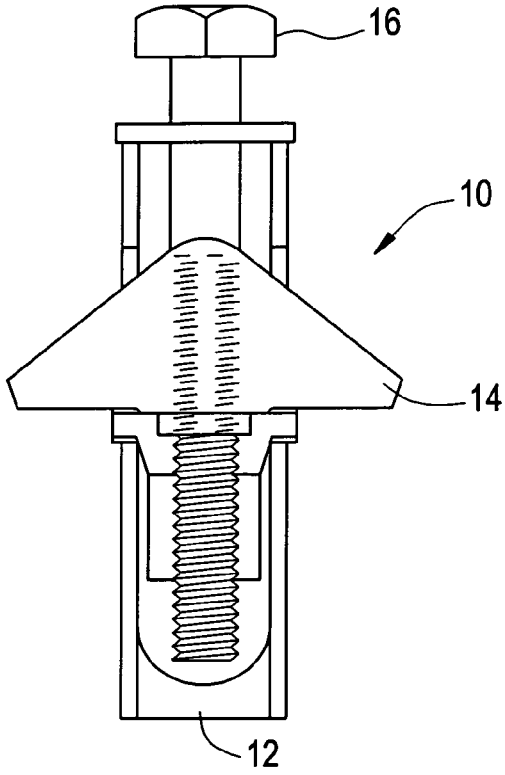
FIG. 3 is an enlarged front view of the meter box ground clamp of FIG. 1.

With reference to the drawings wherein like numerals represent like parts throughout the several figures, a meter box ground clamp in accordance with the present invention is generally designated by the numeral 10. As shown in FIGS. 1, 2, 3 and 4, the ground clamp 10 comprises a clamp body 12, a wedge body 14, a bolt member 16, and a ground engagement bolt 18 which facilitate connecting a ground wire 20 to an enclosure of an electrical meter box 22. The ground clamp 10 is especially useful for mounting a ground wire 20 to a conventional, rectangular meter box 20 having a drip cap 24, a front panel 26, a rear panel (not shown), and side panels 28. Typically, the drip cap 24 of such meter box 20 has a vertically extending lip portion 30 which overhangs and overlaps the top portions 32 of the panels 26, 28. Generally, lip portion 30 is mounted to the top portions 32 of panels 26, 28 by multiple spot welds 29. Although lip portion 30 provides a superior location for mounting the ground clamp 10, it may be mounted to any portion of the meter box 20. To facilitate discussion, the ground clamp 10 will be describe in a vertical orientation, as shown in FIGS. 1–3.

Figure 5:
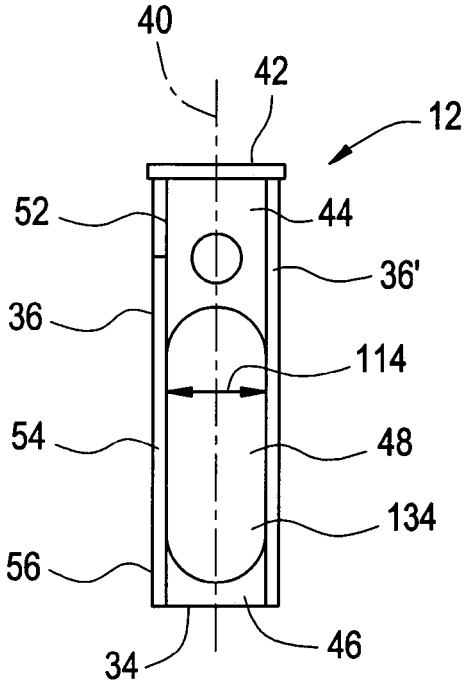
FIG. 5 is an enlarged front view of the clamp body of FIG. 1.
Figure 6:
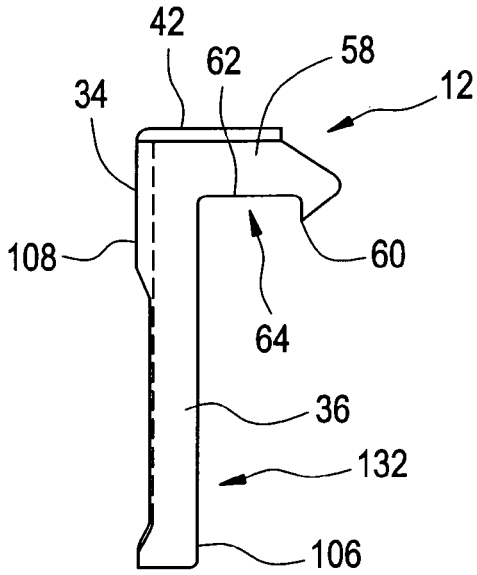
FIG. 6 is a side view of the clamp body of FIG. 5.
Figure 7:
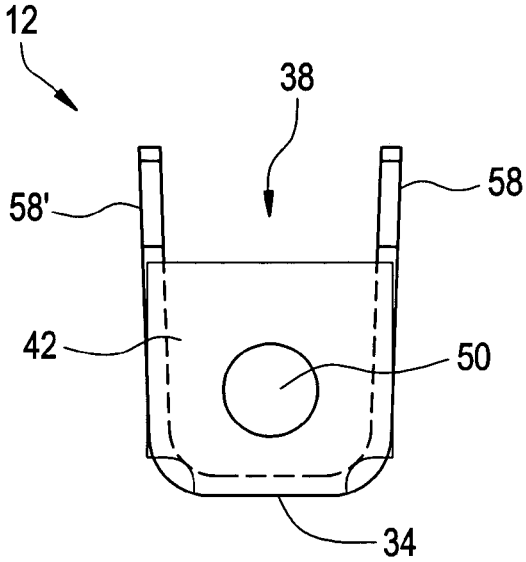
FIG. 7 is a top view of the clamp body of FIG. 5.

With reference to FIGS. 5, 6 and 7, the clamp body 12 is substantially U-shaped, having a base segment 34 and first and second leg segments 36, 36' forming a longitudinally extending, open channel 38. One of the leg segments 36, 36' extends laterally, preferably perpendicularly, from each side of the base segment 34. The clamp body 12 is preferably composed of stainless steel to provide corrosion resistance and superior strength.

The base segment 34 has a longitudinal axis 40 and upper, middle and lower portions 42, 44, 46. The middle portion 44 has a generally circular opening, preferably disposed axially therein. The lower portion 46 has a longitudinally extending slot 48, preferably disposed axially therein. The upper portion 42 of the base segment 34 extends from middle portion 44 into channel 38 between the first and second leg segments 36, 36' and has a substantially circular opening 50, preferably disposed axially therein.

Preferably, upper portion 42 and middle portion 44 form an angle substantially equal to 90°.

Each leg segment has upper, middle and lower portions 52, 54, 56. The upper portion 52 includes an extension segment 58 that extends laterally from the front edge of the middle portion 54. The front portion of the extension segment has a tooth or prong 60 that extends downwardly from the lower edge 62, the rear edge of the prong 60 and the front edge of middle portion 54 define a gap 64. Preferably, the rear edge of the prong 60 substantially perpendicular to lower edge 62 and the front edge extends at an acute angle from the rear edge, forming a sharp point.

Figure 8:
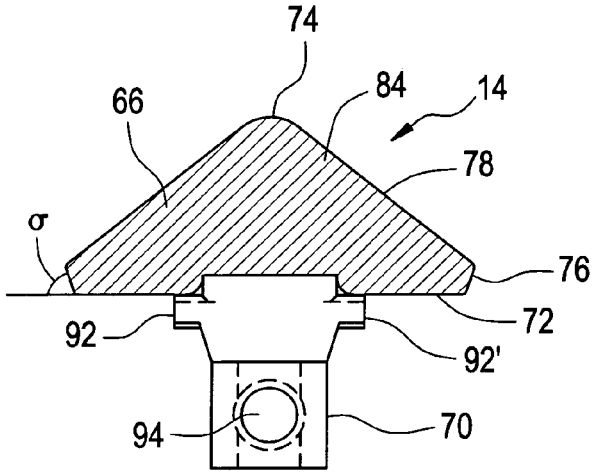
FIG. 8 is an enlarged front view of the wedge body of FIG. 1.
Figure 9:
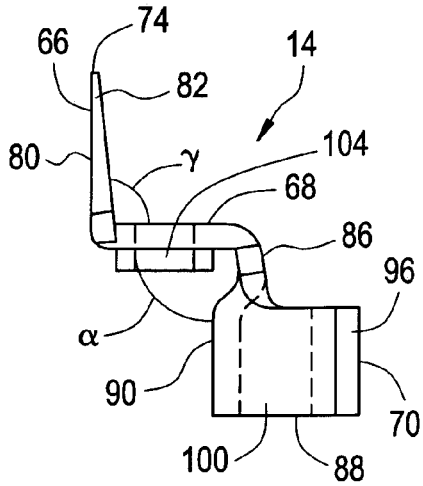
FIG. 9 is a side view of the wedge body of FIG. 8.
Figure 10:
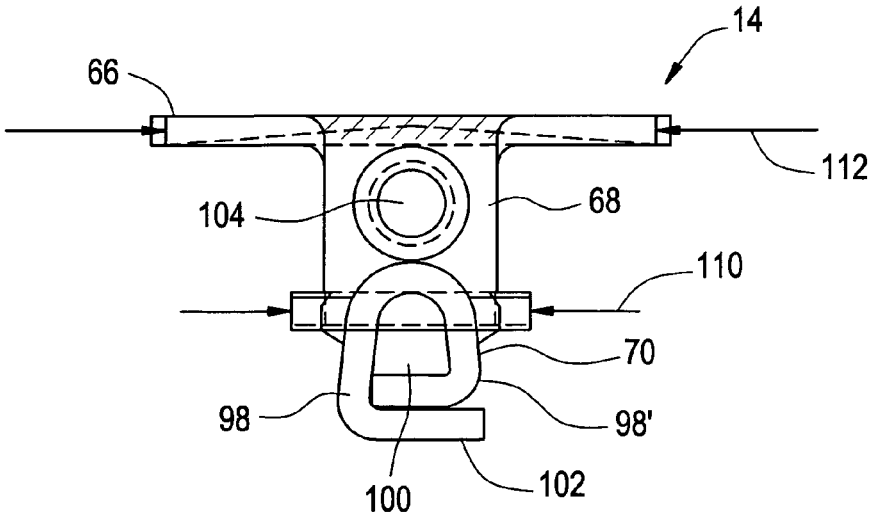
FIG. 10 is a top view of the wedge body of FIG. 8.

With reference to FIGS. 8, 9 and 10 the wedge body 14 has upper, middle and lower segments 66, 68, 70. Preferably, wedge body 14 is composed of stainless steel, brass or bronze. The upper segment 66 extends substantially vertically from a base edge 72 to an upper tip 74. When viewed from the front or rear, the upper segment 66 has a substantially triangular shape. Two edge segments 76 may join the base edge 72 to the two side edges 78, as shown in FIG. 8, to eliminate the personnel safety hazzard that would be created if the base edge 72 was joined directly to the two side edges 78, forming two sharp points. Similarly, the upper tip 74 defines an arcuate-shaped top edge that joins together the two side edges 78 to eliminate the personnel safety hazzard that would be created if the two side edges 78 were joined directly together, forming a sharp point. When viewed from the side (FIG. 9), the upper segment 66 has a wedge profile, widening from the upper tip 74 to the base edge 72. Preferably, the front and rear faces 80, 82 of the upper segment 66 form an angle $\gamma$ substantially equal to 6°. The upper segment front face 80 has multiple serrations 84. Preferably, each serration 84 has a depth substantially equal to 0.005 inches and forms an angle $\sigma$ with the base edge 72 substantially equal to 68°.

When viewed from the side, the lower segment 70 has an arcuate-shaped upper portion 86 and a substantially cylindrical lower portion 88, the upper and lower portions 86, 88 sharing a common wall section 90. First and second wings 92, 92' extend laterally from the side edges of the upper portion 86. A threaded opening 94 extends through the sidewall 96 of the lower portion 88. Preferably, the opening 94 is positioned substantially opposite the common wall section 90 and substantially on the axis of the wedge body 14. The lower portion 88 may be formed by bending first and second arms 98, 98', extending laterally from the sides of the common wall section 90, to form a bore 100, with the distal end portions 102 of each arm 98, 98' overlapping and opening 94 extending through each distal end portion 102.

The wedge body middle segment 68 extends substantially horizontally from the upper segment base edge 72 to the lower segment upper portion 86. An axial threaded opening 104 extends vertically through the wedge body middle segment 68. Preferably, the wedge body upper segment 66 extends at an obtuse angle γ from the wedge body middle segment 68 and the wedge body lower segment 70 extends at right angler a from the wedge body middle segment 68. Preferably angle γ is substantially equal to 960 and angle α is substantially equal to 90°.

Figure 4:
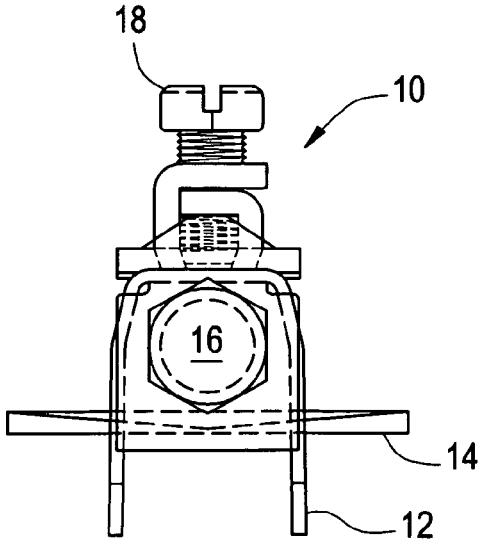
FIG. 4 is an enlarged top view of the meter box ground clamp of FIG. 1.

With additional reference to FIGS. 2, 3 and 4, the wedge body upper segment 66 is positioned adjacent the front edges 106 of the clamp body leg segments 36, 36', with the upper tip 74 pointing toward the extension segment 58 of the clamp body leg segments 36, 36'. The wedge body lower segment 70 is positioned adjacent the rear face 108 of the clamp body base segment 34. The wedge body middle segment 68 extends through the slot 48 of the clamp body base segment 34 and the clamp body channel 38. The width 110 of the wings 92, 92' of the wedge body lower segment 70 and the width 112 of the base edge 72 of the wedge body upper segment 66 are each greater than the width 114 of slot 48 in the lower portion 46 of the clamp body base segment 34, retaining the wedge body 14 to the clamp body 12 while allowing vertical movement of the wedge body 14 relative to the clamp body 12.

Figure 11:
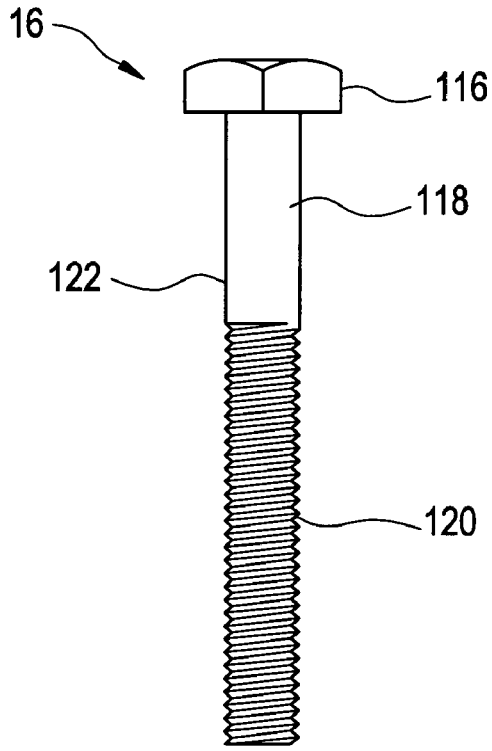
FIG. 11 is an enlarged side view of the bolt member of FIG. 1.

With reference to FIG. 11, the bolt member 16 is composed of brass or silicon bronze, to provide corrosion resistance, high conductivity, and great strength, and has a bolt head 116, a non-threaded proximal shaft segment 118, and a threaded distal shaft segment 120. The shaft 122 extends through the opening 50 of the base segment upper portion 42 and threadably engages the threaded opening 104 of the wedge body middle segment 68, the shaft thread being consistent with the opening thread. The major diameter of the thread is sufficiently smaller than the inside diameter of the opening 50 of the base segment upper portion 42 to allow bolt member shaft 122 to move laterally within opening 50 to a limited extent.

Figure 12:
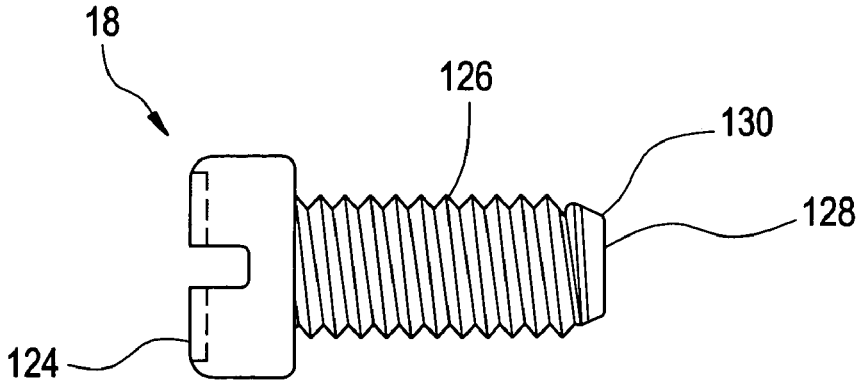
FIG. 12 is an enlarged side view of the ground engagement bolt of FIG. 1.

With reference to FIG. 12, the ground engagement bolt 18 has a head 124 and a threaded shaft 126. The head 124 may have a slot, as shown in FIG. 12, a socket, or other device known in the art for receiving a driver such as the blade of a screw driver. The threaded shaft 126 is received within the threaded opening 94 of the wedge body lower segment 70 and is threadably displaceable therein to clamp a ground wire 20 positioned in the bore 100 of the wedge body lower segment 70. The distal end 128 of the ground engagement bolt shaft 126 may have a circumferential, axially extending knife-like ridge 130 which digs into the ground wire 20 when the ground engagement bolt 18 is torqued, preventing pull-out of the ground wire 20. The ground engagement bolt 18 is composed of brass to provide corrosion resistance and super electrical conductivity.

Figure 15:
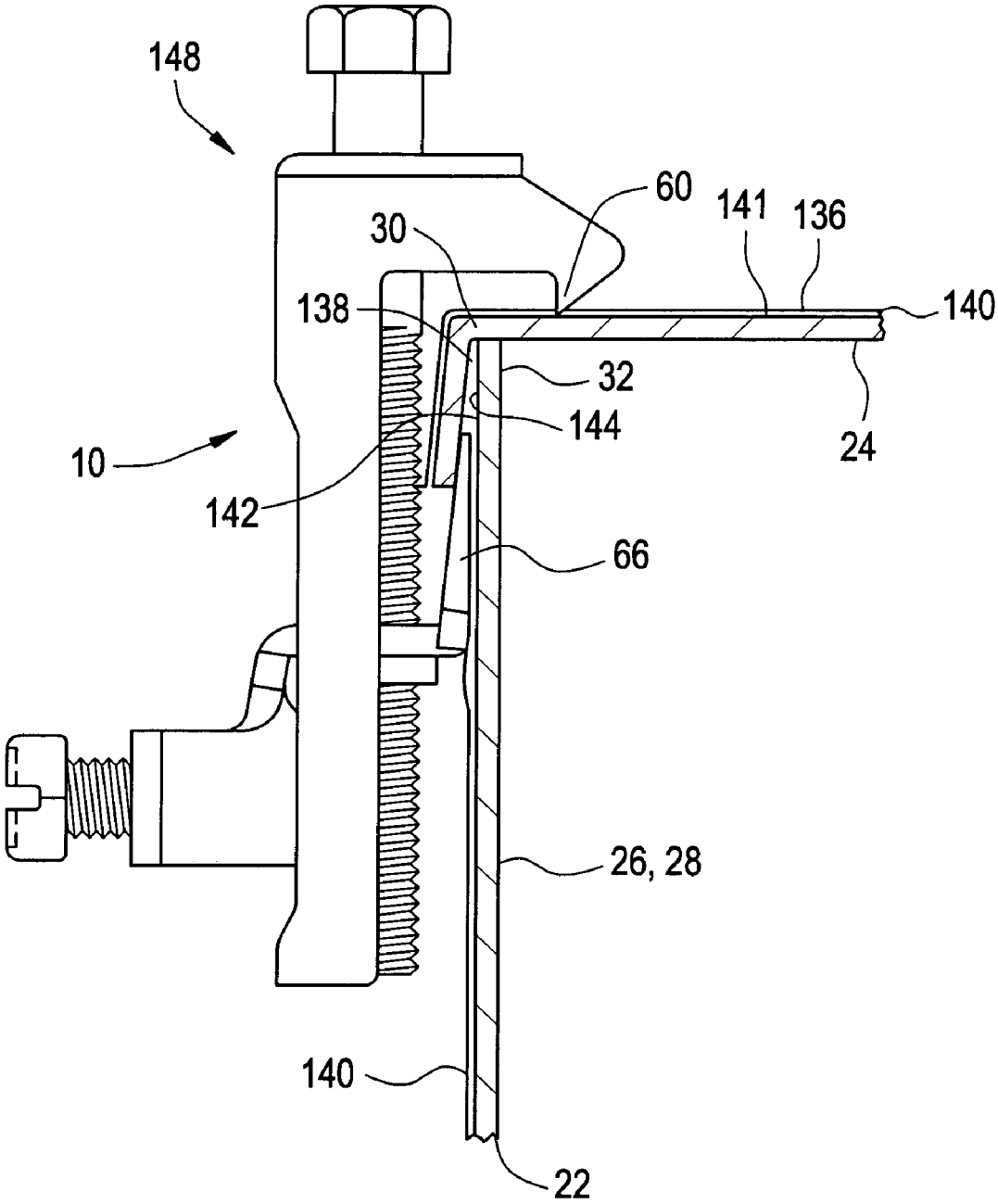
FIG. 15 is an enlarged side view, partly in cross-section, of the ground clamp and meter box of FIG. 1.

With reference to FIGS. 1 and 15, the ground clamp 10 is preferably installed by first ensuring that the wedge body middle segment 68 is positioned in the lower part 132 of clamp body channel 38 and the lower part 134 of slot 48. That is, the bolt member 16 is rotated in a counter-clockwise direction until the wedge body middle segment 68 is positioned in the lower part 132 of clamp body channel 38 and the lower part 134 of slot 48. The ground clamp 10 is positioned between two of the spot welds 29 mounting the drip cap lip portion 30 to one of the side panels 28, or to the front panel 26, with the clamp body prongs 60 engaging the meter box upper surface 136 and the front face 80 of the wedge body upper segment 66 contacting the panel 26, 28. Bolt member 16 is then rotated in a clockwise direction, drawing the wedge body upper segment 66 upwards along the panel 26, 28 until the upper tip 74 of the wedge body upper segment 66 is positioned at the seam 138 or overlap joint between the drip cap lip portion 30 and the top portion 32 of the panel 26, 28. Additional torque is applied to bolt member 16, wedging the wedge body upper segment 66 into the seam 138 between the drip cap lip portion 30 and the panel 26, 28 and causing the points of the clamp body prongs 60 to penetrate the paint 140 coating the drip cap upper surface 136. The triangular-shape and the wedge profile of the wedge body upper segment 66 facilitates entry into seam 138.

It should be appreciated that the abutting surfaces 142, 144 of the drip cap lip portion 30 and the top portion 32 of the panel 26, 28 are not coated with paint, to allow the spot welding operation that joins the drip cap 24 to the panels 26, 28. Therefore, the metal-to-metal contact between clamp body prongs 60 and the drip cap 24 and between the wedge body upper segment 66 and drip cap lip portion surface 142 and panel top portion surface 144 provide an excellent conductive path for grounding the meter box 22. The abrading surface provided by the serrations 84 on the front face 80 of the wedge member upper segment 66 removes any coating (e.g. surface corrosion, surface contamination, etc.) on the panel top portion surface 144 that might otherwise interfere with the electrical connection between the ground clamp 10 and the meter box 22.

After the ground clamp 10 is mounted to the meter box 22, a ground wire 20 is inserted into the bore 100 of the wedge body lower segment 70 and the ground engagement bolt 18 is torqued to clamp the ground wire 20 therein. A gel-filled boot 146 may be inserted over the upper portion 148 of the clamp body 12 (FIG. 15) to provide a weather-tight seal which prevents the meter box 22 from corroding in the area from which the paint 140 has been removed, that is where the clamp body prongs 60 have penetrated the paint 140.

Figure 13:
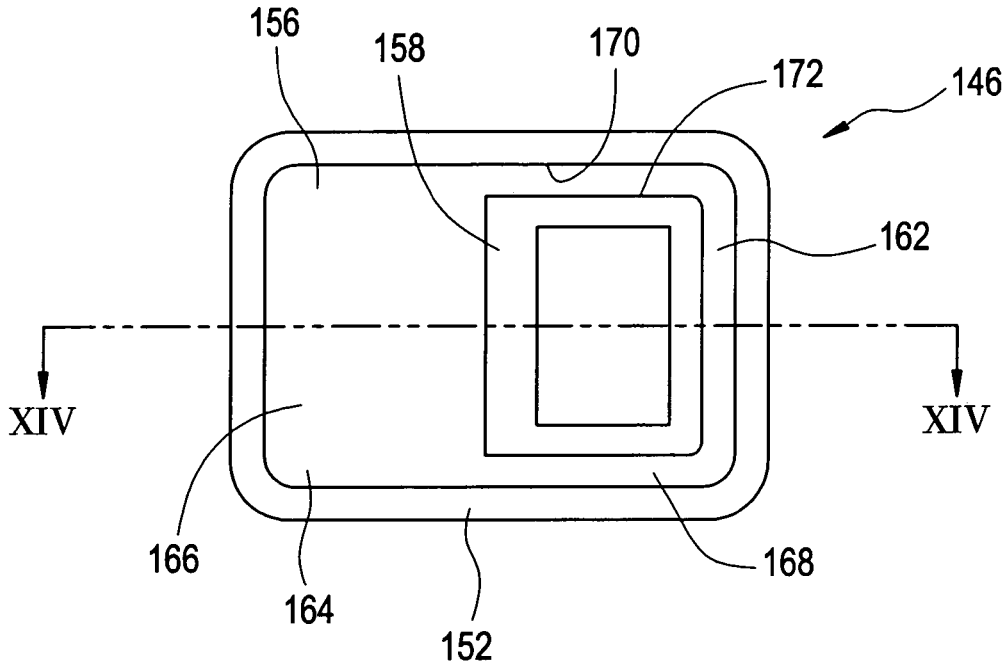
FIG. 13 is a bottom view of a boot for the meter box ground clamp of FIG. 1.
Figure 14:
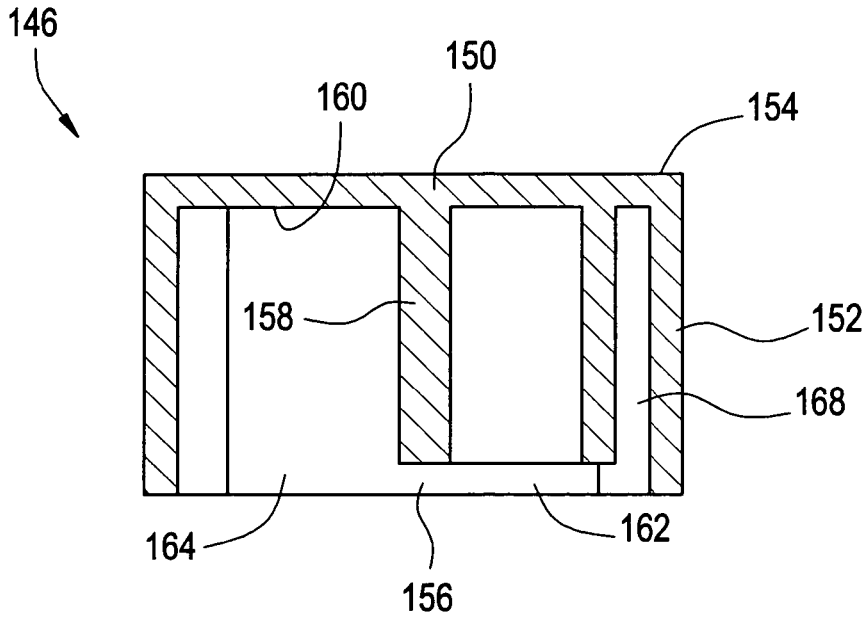
FIG. 14 is a cross-section view of the boot of FIG. 13 taken along line XIV—XIV.

With reference to FIGS. 13 and 14, boot 146 has a rectangular upper wall 150 and an outer skirt 152 extending downwardly from the outer perimeter 154 of the upper wall 150, the upper wall 150 and outer skirt 152 forming an outer cavity 156. An inner skirt 158 extends downwardly from the lower surface 160 of the upper wall 150 within a first end portion 162 of the outer cavity 156. Preferably, the second end portion 164 of the outer cavity 156 contains a gel 166 for forming a water-tight and air-tight seal at the meter box upper surface 136. For example, the outer cavity second end portion 164 may be filled with Sealrite SRG-TS™. The boot 146 is installed by inserting the inner skirt 158 into channel 38, with the upper portion 148 of the clamp body 12 being received within the outer cavity first end portion 162 in the space 168 between the outer and inner skirts 152, 158 and the front portion of the extension segment 58 of the clamp body leg segments 36, 36' being received in the second end portion 164 of the outer cavity 156. The upper portion 148 of the clamp body 12 frictionally engages the inner surface 170 of the outer skirt 152 and the outer surface 172 of the inner skirt 158 to prevent inadvertent removal or loss of the boot 146.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A meter box ground clamp for clamping a ground wire to a metallic meter box, the meter box including a drip cap, a front panel, a rear panel, and left and right side panels, the drip cap having an edge portion forming an overlap joint with an upper end portion of at least one of the panels, the drip cap edge portion and the panel upper end portion having substantially abutting bare-metal surfaces, the meter box having an exterior surface covered by a corrosion inhibiting coating, the meter box ground clamp comprising:

a U-shaped clamp body defining a vertical axis and including first and second leg segments, each of the leg segments having a laterally extending upper extension segment a base segment forming a vertically extending, open channel with the leg segments, the base segment having a lower portion having a vertically extending slot, a middle portion, and an upper portion defining an opening and extending at an angle from the middle portion into the channel;

a wedge body including an upper segment disposed proximate to the clamp body legs and having a substantially triangular shape, a lower segment disposed proximate to the clamp body base segment and having an upper portion and a substantially cylindrical lower portion, the lower portion having a sidewall defining an axially extending bore and a laterally extending threaded opening, a middle segment extending substantially horizontally from the lower segment, through the slot of the clamp body base segment, to the upper segment and defining a vertically extending, axial threaded opening;

a bolt member including a bolt head disposed above the upper portion of the clamp body base segment, and a shaft extending downwardly from the bolt head through the opening of the upper portion of the clamp body base segment to a distal end, at least a portion of the shaft having a threaded surface threadably engaged with the opening of the wedge body middle segment; and a ground engagement bolt including a bolt head, and a threaded shaft extending from the bolt head, the threaded shaft being received within the threaded opening of the wedge body lower segment and being threadably displaceable therein to clamp a ground wire positioned within the bore of the wedge body lower segment;

wherein the extension segments of the clamp body legs are adapted for engaging the exterior surface of the drip cap and the bolt member is adapted for threadably driving the wedge body upper portion into the meter box overlap joint whereby the wedge body upper portion mechanically engages the abutting surfaces of the edge portion of the meter box drip cap and the upper end portion of the meter box panel to electrically connect the ground clamp to the meter box.

2. The meter box ground clamp of claim 1 wherein the upper portion of the wedge body lower segment includes first and second laterally extending wings having a width, the wedge body upper segment has a lower edge having a width, and the slot of the lower portion of the clamp body base segment has a width, the width of the wings and the width of the base edge each being greater than the width of the slot, whereby the wedge body is retained to the clamp body while allowing vertical movement of the wedge body relative to the clamp body.

3. The meter box ground clamp of claim 2 wherein the lower portion of the wedge body lower segment includes arcuate-shaped first and second arms having overlapping distal end portions, each of the distal end portions defining a threaded opening, the opening of the distal end portion of the first arm being aligned with the opening of the distal end portion of the second arm to define the threaded opening of the lower portion of the wedge body lower segment.

4. The meter box ground clamp of claim 1 wherein the wedge body upper segment extends at an obtuse angle ($\gamma$) from the wedge body middle segment and the wedge body lower segment extends at a right angle ($\alpha$) from the wedge body middle segment.

5. The meter box ground clamp of claim 4 wherein angle $\gamma$ is substantially equal to 96° and angle $\alpha$ is substantially equal to 90°.

6. The meter box ground clamp of claim 1 wherein the wedge body upper segment has front and rear faces defining a wedge-shape profile widening from a top edge to a bottom edge.

7. The meter box ground clamp of claim 6 wherein the front and rear faces of the wedge body upper segment form an angle substantially equal to 6°.

8. The meter box ground clamp of claim 6 wherein the front face of the wedge body upper segment has an abrading surface.

9. The meter box ground clamp of claim 8 wherein the front face of the wedge body upper segment has a plurality of serrations, each of the serrations having a depth substantially equal to 0.005 inches and forming an angle with the base edge substantially equal to 68°.

10. The meter box ground clamp of claim 1 wherein each leg segment has upper, middle and lower portions, the extension segment extending laterally from a front edge of the middle portion.

11. The meter box ground clamp of claim 10 wherein the extension segment includes a front portion having a downwardly extending tooth, the tooth being adapted for penetrating the corrosion inhibiting coating on the meter box drip cap.

12. The meter box ground clamp of claim 11 wherein the extension segment has a lower edge and the tooth has front and rear edges joined at an acute angle, forming a sharp point.

13. The meter box ground clamp of claim 1 wherein the bolt member shaft includes a non-threaded proximal shaft segment, and a threaded distal shaft segment.

14. The meter box ground clamp of claim 1 wherein the threaded shaft of the ground engagement bolt includes a distal end having a circumferential, axially extending knife-like ridge adapted for digging into the ground wire when the ground engagement bolt is torqued.

15. A meter box ground clamp for clamping a ground wire to a metallic meter box, the meter box including a drip cap, a front panel, a rear panel, and left and right side panels, the drip cap having an edge portion forming an overlap joint with an upper end portion of at least one of the panels, the drip cap edge portion and the panel upper end portion having substantially abutting bare-metal surfaces, the meter box having an exterior surface covered by a corrosion inhibiting coating, the meter box ground clamp comprising:

a U-shaped clamp body defining a vertical axis and including first and second leg segments, each of the leg segments having a laterally extending upper extension segment having a downwardly extending tooth, a base segment forming a vertically extending, open channel with the leg segments, the base segment having a lower portion having a vertically extending slot, a middle portion, and an upper portion defining an opening and extending at an angle from the middle portion into the channel;

a wedge body including an upper segment disposed proximate to the clamp body legs and having front and rear faces having a substantially triangular shape and defining a wedge-shape cross section, the front face having an abrading surface, a lower segment disposed proximate to the clamp body base segment and having an upper portion and a substantially cylindrical lower portion, the lower portion having a sidewall defining an axially extending bore and a laterally extending threaded opening, a middle segment extending substantially horizontally from the lower segment, through the slot of the clamp body base segment, to the upper segment and defining a vertically extending, axial threaded opening;

a bolt member including a bolt head disposed above the upper portion of the clamp body base segment, and a shaft extending downwardly from the bolt head through the opening of the upper portion of the clamp body base segment to a distal end, the shaft including a non-threaded proximal shaft segment, and a threaded distal shaft segment threadably engaged with the opening of the wedge body middle segment; and a ground engagement bolt including a bolt head, and a threaded shaft extending from the bolt head, the threaded shaft being received within the threaded opening of the wedge body lower segment and being threadably displaceable therein to clamp a ground wire positioned within the bore of the wedge body lower segment;

wherein the extension segments of the clamp body legs are adapted for engaging the exterior surface of the drip cap, the bolt member is adapted for threadably driving the wedge body upper portion into the meter box overlap joint whereby the wedge body upper portion mechanically engages the abutting surfaces of the edge portion of the meter box drip cap and the upper end portion of the meter box panel to electrically connect the ground clamp to the meter box, and the clamp body tooth is adapted for penetrating the corrosion inhibiting coating on the meter box drip cap to further electrically connect the ground clamp to the meter box.

16. The meter box ground clamp of claim 15 further comprising a boot including a rectangular upper wall having a lower surface and an outer perimeter;

an outer skirt extending downwardly from the outer perimeter of the upper wall, the upper wall and outer skirt forming an outer cavity having oppositely disposed first and second end portions;

an inner skirt extending downwardly from the lower surface of the upper wall within the first end portion of the outer cavity; and a gel disposed within the second end portion of the outer cavity;

wherein the inner skirt is inserted into the channel formed by the clamp body base segment and leg segments and a front portion of the extension segments of the clamp body leg segments are received in the second end portion of the outer cavity, whereby the gel provides a weather-tight seal preventing the meter box enclosure from corroding in the area where the clamp body tooth has penetrated the corrosion inhibiting coating.

* * * * *